US006083121A

United States Patent [19]

Hovey

[11] Patent Number: 6,083,121

[45] Date of Patent: Jul. 4, 2000

[54] ADJUSTABLE GOLF TEE

[76] Inventor: Gordon E. Hovey, 2760 Carousel Cr., Apt. 303, Gloucester, Ontario, Canada, K1T 2N4

[21] Appl. No.: 09/106,130

[22] Filed: Jun. 29, 1998

[30] Foreign Application Priority Data

Jun. 27, 1997 [CA] Canada ..... 2209197
Nov. 12, 1997 [CA] Canada ..... 2220840

[51] Int. Cl.[7] ..... A63B 57/00
[52] U.S. Cl. ..... 473/396; 473/387
[58] Field of Search ..... 473/387–403

[56] References Cited

U.S. PATENT DOCUMENTS

| | | | |
|---|---|---|---|
| 1,637,551 | 8/1927 | Clausing | 473/396 |
| 1,803,907 | 5/1931 | Kruse | 473/398 |
| 2,079,387 | 5/1937 | Sickmiller | 473/398 |
| 3,516,664 | 6/1970 | Brennan | 473/396 |
| 3,858,878 | 1/1975 | Tassone | 473/398 |
| 4,516,780 | 5/1985 | Tabet | 473/398 |
| 5,569,101 | 10/1996 | O'Keeffe . | |
| 5,728,013 | 3/1998 | Luther, Sr. | 473/396 |
| 5,766,100 | 6/1998 | Dilmore | 473/396 |
| 5,776,014 | 7/1998 | Gustine | 473/396 |

FOREIGN PATENT DOCUMENTS 690490 7/1964 Canada .

OTHER PUBLICATIONS

Floyd L. Gustine, Driving Range "Adjustable Tee", Jan. 1998.

*Primary Examiner*—Steven Wong
*Attorney, Agent, or Firm*—Charles P. Boukus, Jr.

[57] ABSTRACT

Disclosed is an invention relating to golf tees on practice ranges and more particularly to the construction of a golf tee having a ball support portion associated with a piston portion, the piston being adapted to be vertically moveable within a housing secured within a base of the practice tee. In one embodiment, the piston and housing have a mechanism to detachably lock the two together and to provide controlled "drag" to relative movement of the two so as to provide a "feel" to the vertical adjustment of the ball support portion. In another embodiment, the ball support and piston are integrally molded of a flexible plastic material and the housing is of a harder plastic material. The piston reciprocates within the housing and has a lower end with a slit skirt encompassing a circular wire spring which forces the skirt outwardly with contact with the housing walls to provide the desired "drag".

11 Claims, 7 Drawing Sheets

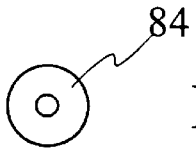
Fig. 4
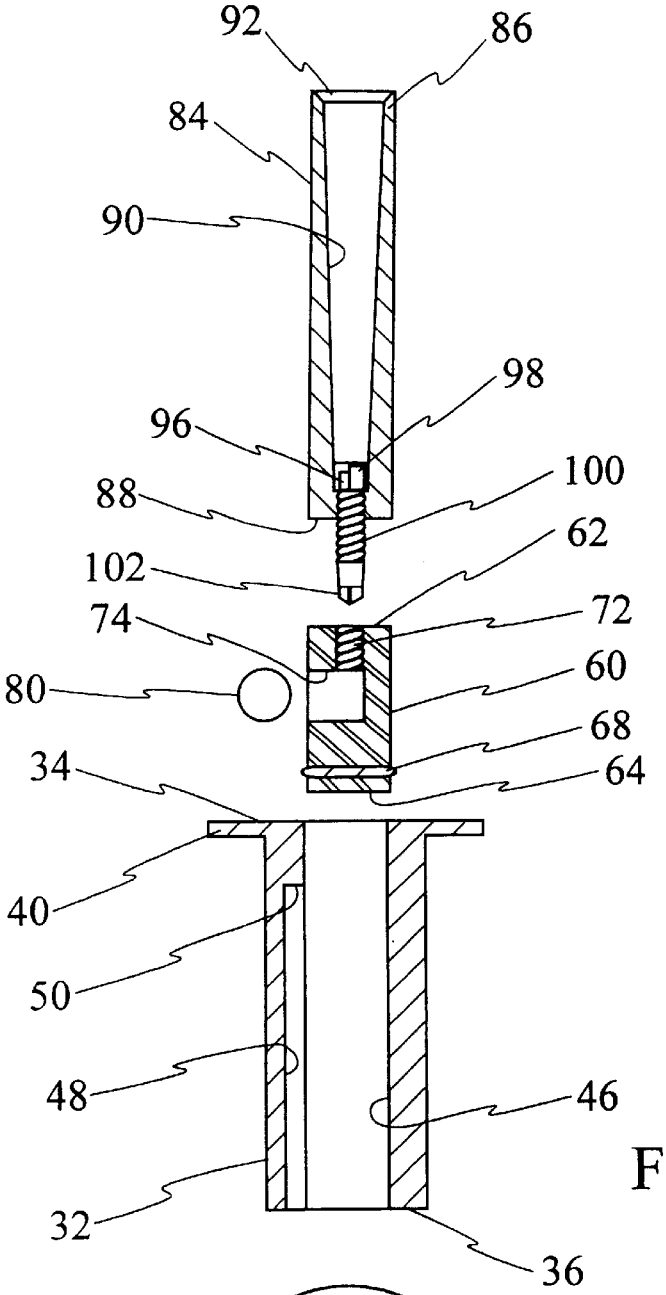
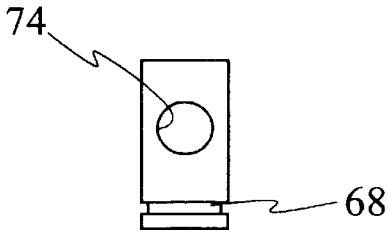
Fig. 5
Fig. 3
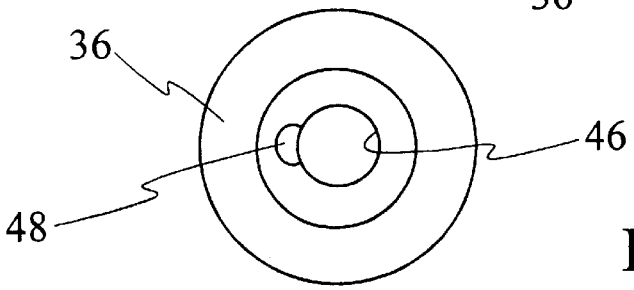
Fig. 6

ADJUSTABLE GOLF TEE

FIELD OF THE INVENTION

The invention relates to golf tees on practice ranges and more particularly to the construction of a golf tee having a ball support portion detachably secured to a piston portion, the piston adapted to be vertically moveable within a housing secured within a base of the practice tee. The piston and housing have a mechanism to detachably connect the two together and to provide controlled "drag" to relative movement of the two so as to provide a "feel" to the vertical adjustment of the ball support portion.

BACKGROUND OF THE INVENTION

Golf has increased dramatically in popularity in the last several years with new courses and driving ranges being built at a rapid pace.

One of the drawbacks with golf range practice areas and tees is that the rubber tee or the like is usually at a fixed height, often a height which is not preferred by some of the users of the tee. Also, the replacement of such golf tees when worn down or broken becomes a problem.

There are complicated automatic mechanisms, including devices to see balls on tees, but they have never been as popular as one would be lead to believe from the marketing of such devices, largely due to the complexity of installation, breakdowns and costly repairs associated with them.

Accordingly, there is a need for a simple golf tee construction which enables the height of the tees to be adjusted but which is easily and inexpensively installed and easy and inexpensive to repair, if broken.

SUMMARY OF THE INVENTION

The invention provides an adjustable golf tee comprising a housing and a tee ball support portion connected to a piston, which piston is slidably contained within a housing.

More particularly the invention provides a golf ball tee device for a golf practice tee comprising a housing for securement with a base of the practice tee, the housing having a bore with an upper end and lower end, the upper bore end having an opening. A piston moves within the housing bore and a golf ball support is connected to the piston. The housing box and piston cooperate to provide controlled friction drag to relative movement therebetween and the housing and piston include means to prevent longitudinal separation of the piston from the housing when in operation.

In one embodiment, the piston contains one or more grooves, each to retain an "O" ring which provides certain drag on the inner surface of the bore of the housing to provide "feel" in the adjustment of the height of the ball support portion. In this embodiment, a machine screw is molded to the bottom end of the ball support portion and is adapted to have a screw connection with a screw hole in the upper end of the piston. The piston also has a radially extending aperture communicating with the bottom of the screw hole, which aperture is adapted to loosely contain a ball bearing or detent means. Part of the ball bearing is adapted to move within a longitudinal groove in the inner bore of the housing.

Another embodiment provides a tee device comprising an integrally molded ball support and piston, the piston located within a cylindrical housing and the ball support extending through an opening in the upper end of the housing. The integral ball support and piston are made of a flexible, urethane material whereas the cylinder housing is made of a hard urethane material. Preferably, the piston has a bore extending inwardly from the bottom of the piston and a groove in which a spring ring is located. To facilitate ease of inserting the ring, the skirt of the piston may be slit. This also assists in the spring providing outward force to the skirt in relation to the housing wall to provide the desired feel and drag to be adjusted to the tee.

The invention will be appreciated more readily from the following description of a preferred embodiment of the invention.

BRIEF DESCRIPTION OF THE DRAWINGS

FIG. 3 is an exploded view of the parts of the tee.

FIG. 4 is a bottom view of the ball support and showing the screw.

FIG. 5 is a side elevational view of the piston rotated 90° from that screw in FIG. 3.

FIG. 6 is a bottom view of the housing.

DESCRIPTION OF PREFERRED EMBODIMENTS

Figure 1:
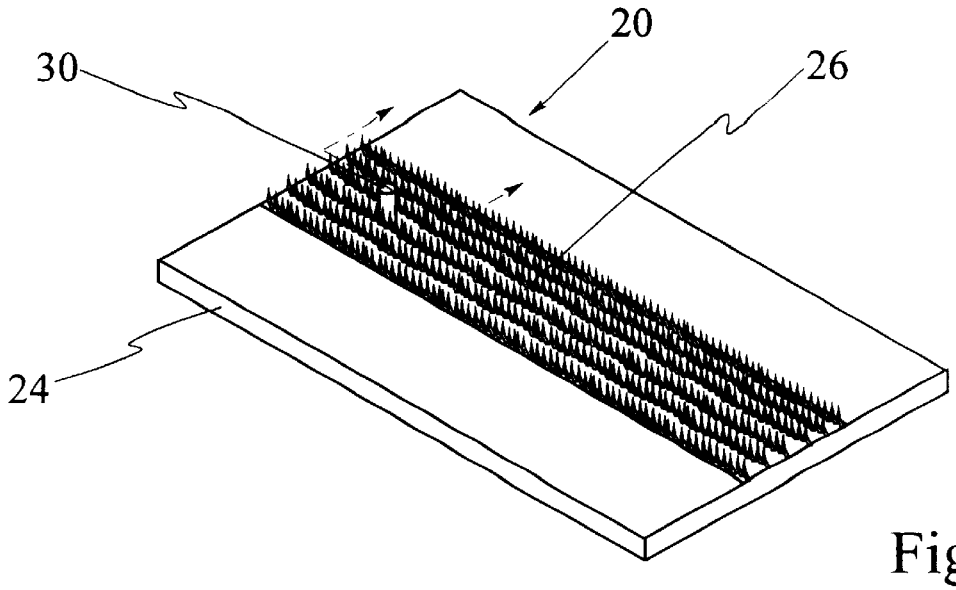
FIG. 1 is a perspective view of a tee mat with the tee shown in place.

Turning to FIG. 1, a perspective view of a golf practice tee 20 is shown with the base 24 of the practice tee having a masonry construction to which a grass-like carpet material 26 is secured by means not shown. Within the periphery of the practice tee 20 and extending upwardly from base 24 through material 26, is a tee device 30.

Figure 2:
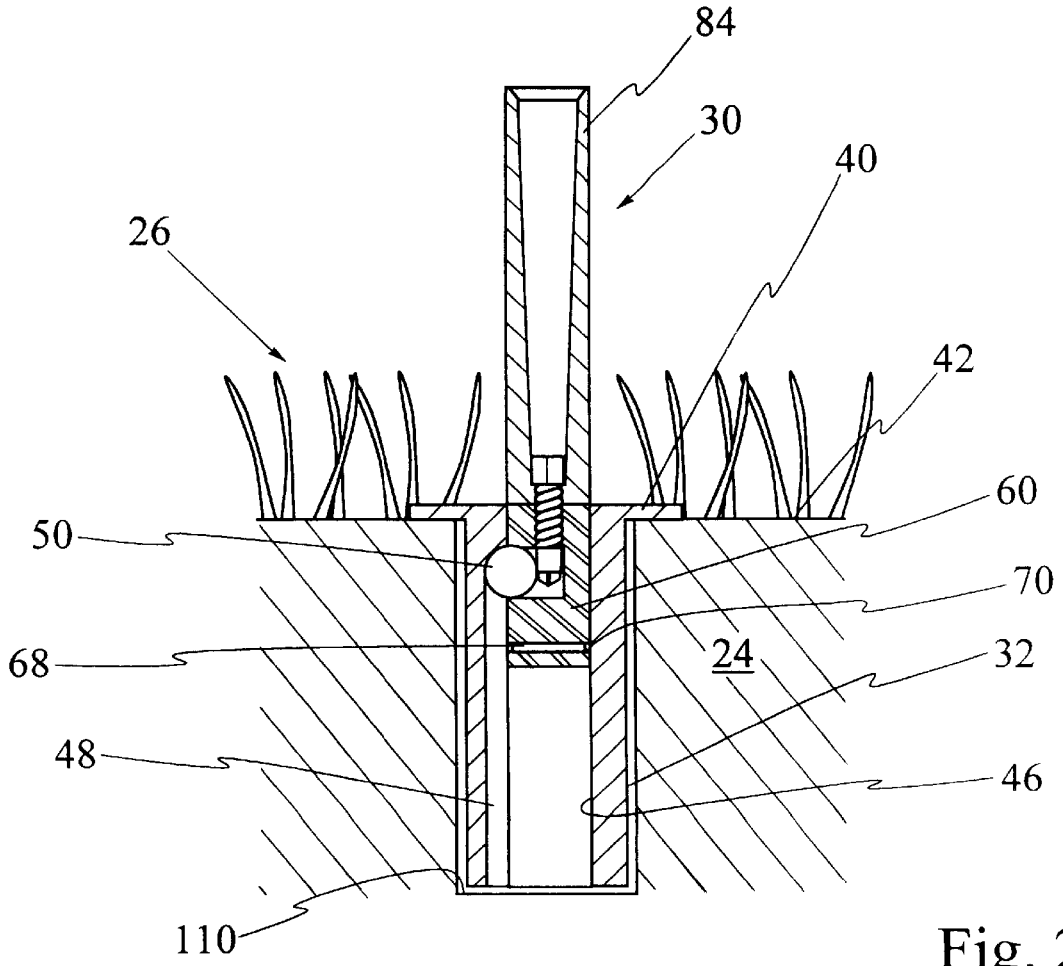
FIG. 2 is a sectional view through the tee of FIG. 1 taken along lines 2—2 of FIG. 1.

FIG. 2 shows the construction of the tee device 30 in cross-sectional view and FIG. 3 shows an exploded view of the tee device 30.

Tee device 30 comprises a cylindrical, lower base or housing 32 having an upper end 34 and lower end 36. Upper end 34 has a peripheral lip 40 which contacts the upper surface 42 of masonry base 24. Housing 32 has a central bore 46 with a groove 48 extending longitudinally upwardly, as shown in FIGS. 2 and 3, from lower end 36 to a round or bevelled end 50 adjacent upper housing end 34.

Cylindrical piston 60 has upper and lower ends 62 and 64 and is adapted to slide within bore 46. Adjacent lower end 64 of piston 60, there is a peripheral groove 68 adapted to hold an "O" ring 70. Upper end 62 of piston 60 has a threaded bore 72, which threaded bore 72 extends longitudinally to meet a radially extending bore 74. Bore 74 is adapted to loosely contain ball bearing or detent means 80.

Tee device 30 further comprises cylindrical ball support 84 with upper and lower ends 86 and 88 and stepped or tapered cylindrical bore 90. Upper end 86 has a slight inner bevelled surface 92 and lower end 88 has a screw 96 with a knurled head 98. Screw 96 is preferably molded into tee support 84 so that rotation of ball support 84 rotates screw 96. Screw 96 has threaded shank 100 and an unthreaded, slightly rounded tip 102.

Masonry base 24 has or is made with a hole 110 (FIG. 2) which has a diameter such that the housing 32, when pushed down, fits snugly therein with flange 40 on base surface 42. "O" ring 70 is assembled in piston groove 68 and ball or detent 80 is inserted into bore 74. Bore 74 is deep enough so that ball 80 is totally within bore 74. Ball support 84, with screw 96 molded to its lower end 88, is then rotated so that screw 96 is threaded part way into threaded piston bore 72 but not enough to have screw end 102 radially displace ball 80. The assembly of ball support 84, piston 60 and ball 80 is then inserted into the upper portion of housing 32 and the radial bore 74 aligned with groove 48. "O" ring 70 causes "drag" to relative movement between piston 60 and housing 30. This "drag" enables ball support 84 to then be turned down fully relative to piston 60, whereby ball 80 is forced radially outwardly by screw tip 102 into groove 48, locking the ball support 84 and piston to housing 32 for limited vertical travel between a lower position and an upper position. In the upper position, ball 80 contacts bevelled end 50 of groove 48, (as shown in FIG. 2).

If ball support 84 breaks or a change is desired, the old support 84 need only be unscrewed sufficiently whereby the unthreaded tip 100 is out of the radial bore 74, thereby allowing the ball 80 to be cammed fully into the bore 74 by bevel or rounded surface 50. Piston 60, ball support 84 and ball 80 are then removed as a unit. The old ball support 84 is then completely unscrewed from piston 60 and a new ball support 84 is then screwed to piston 60 and the assembly or new unit connected to housing 32.

The "O" ring 70 provides not only a resistance to initial turning of the piston, ball and ball support unit when ball support 84 is turned, but it also provides resistance to height adjustment such as to hold the tee at the desired height thereby permitting height adjustment as desired. The "drag" also provides for a "feel" for tee height adjustment missing from prior art tee devices.

In one prototype embodiment, the ball support 84 is of a soft, flexible polyurethane (6501) with piston 60, ball 80 and screw 100 of stainless steel and housing 32 of a harder polyurethane (6405).

The device however can be fabricated of other plastic materials and other non-rusting materials such as brass or bronze or entirely of plastic, the ball support device 84 for example, being made with a harder plastic at the lower end to which threads can be formed in place of a metal screw.

It will be appreciated to those skilled in the art that other forms of bases 24 of practice tees may be constructed using wood, metal or plastic. Holes to accommodate housing 32 may be appropriately formed in the original construction of the base or drilled in a retrofit construction to adopt the new adjustable tees.

Figure 7:
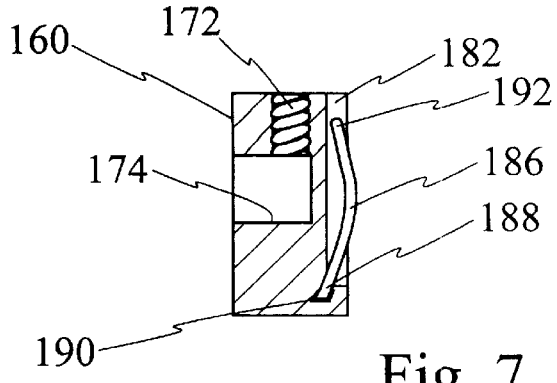
FIG. 7 is a sectional view in elevation of an alternative to the a piston.

Although I have set forth in the preferred embodiment the use of at "O" ring to produce some "drag" or resistance to relative movement between piston 60 and housing 32, other forms of devices to provide a "controlled and smooth drag" are contemplated. For example, as shown in FIG. 7, the piston 160 has threaded bore 172 and radial bore 174 for purposes similar to those like features in FIGS. 2 and 3. However, piston 160 has a recess 180 and longitudinal groove 182 associated therewith. Leaf spring 186 has end 188 pressfitted into recess 190 and has free end 192 lying longitudinally along and within groove 182. Spring 186 is naturally biased outwardly at its middle to contact housing bore 46 to provide "drag" feel. If two leaf spring assemblies are used, they can be diametrically opposed and 90° to radial bore 174.

Figure 8:
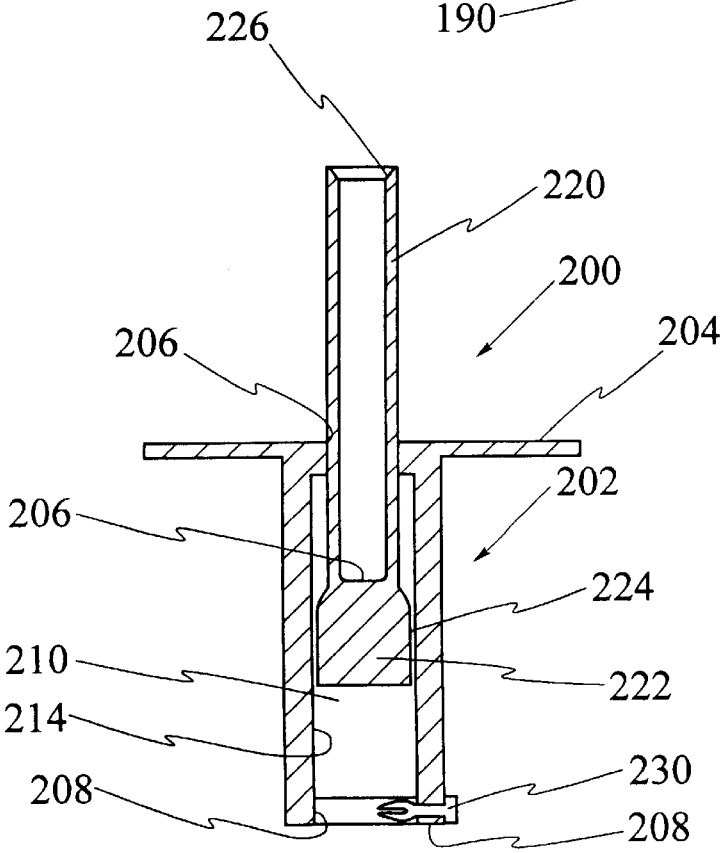
FIG. 8 illustrates in sectional view a further embodiment of the invention.

Turning to FIG. 8, a further embodiment of the invention is shown, which embodiment is a preferred embodiment due to its ease of manufacture and cost effective price. Tee device 200 has cylindrical housing 202 of molded hard urethane plastic with upper flange 204, upper opening 206, lower opening 208 and bore 210 having walls 214. Bore 210 has a diameter slightly larger than that of opening 206. Ball support 220 and piston 222 are integrally molded of a flexible urethane. Ball support 220 is of tubular construction with upper, inwardly chamfered edge 226 and has a diameter similar to that of upper opening 206. Piston 222 has a diameter similar to that of bore 210. There is a slight friction fit between support 220 and opening 206 and piston 222 and bore 210, primarily between piston wall 224 and bore walls 214. Nevertheless, ball support 220 and piston 222 are manually movable within the respective opening 206 and bore 210 by pushing or pulling on ball support 220. Friction primarily between the piston wall 224 and bore wall 214 permit the ball support 220 to be positioned at a desired height relative to the housing 202. The bottom of the housing 202 may be left open at 208 with a plastic rivet 230 inserted through aperture 232 to simply hold the ball support and housing in an assembled condition and to prevent separation during installation. A rivet like retainer 230 may extend completely through the housing 202 or a cotter pin (not shown) could be used.

The bottom of housing 200 will be effectively closed off when the tee device 200 is installed in the opening in a base 24 (FIG. 1). However, I prefer to cap or plug the lower end opening 206 with a friction fitted or glue secured cap 240 shown in FIG. 9, in which case piston 222 is modified to provide at least one axially directed channel or groove 244 to allow air to move from below the piston to above the piston and vice versa. Preferably there are at least two diametrically opposed channels or grooves 244. It will be appreciated that end 208 could be plugged with a plug 246 shown in dotted lines in FIG. 9.

Figure 10:
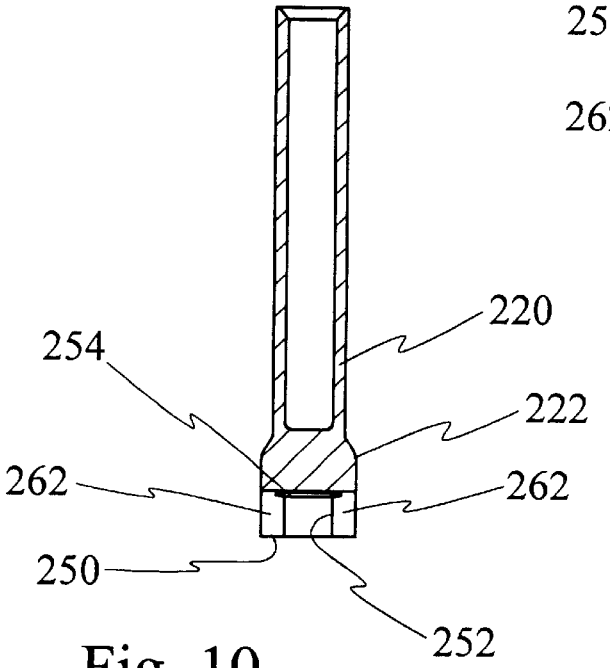
FIG. 10 shows in section a further modified ball support and piston of the tee shown in FIG. 8.
Figure 11:
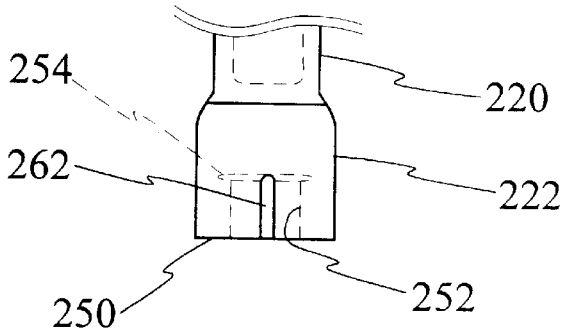
FIG. 11 shows a non-sectional portion of the piston shown in FIG. 10 rotated 90°.

In a still more preferred embodiment of the piston 222, as shown in FIGS. 10, 11, the lower end 250 of piston 222 has a bore 252 with a slightly diametrically enlarged circular groove 254 at its upper end, bore 252 giving bottom 250, a skirt-like configuration.

Figure 12:
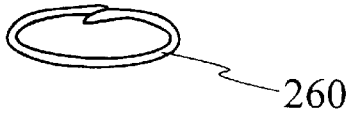
FIG. 12 is an illustration of the wire spring.

Flexible, circular wire spring 260 shown in FIG. 12 is insertable within bore 252 and held in groove 254. Opposed slits or slots 262 in the sides of piston 222 extend from bottom 250 to adjacent groove 254 and assist in permitting the insertion of spring 260 into bore 252 and groove 254.

The split 262 in the piston lower end 250 also provides enhanced flexibility to the lower end or skirt of the piston. Accordingly, the spring 260 tends to force the lower end or skirt section 250 of the piston 222 outwardly providing a friction drag between piston 222 and housing bore 210 resulting in an appropriate and consistent drag and "feel" to movement of the ball support. It will be appreciated that the diametric relationship of the piston and bore 210 need not be so critical when this embodiment is used since the spring forces the skirt outwardly to cause suitable frictional contact to allow controlled relative movement.

Figure 9:
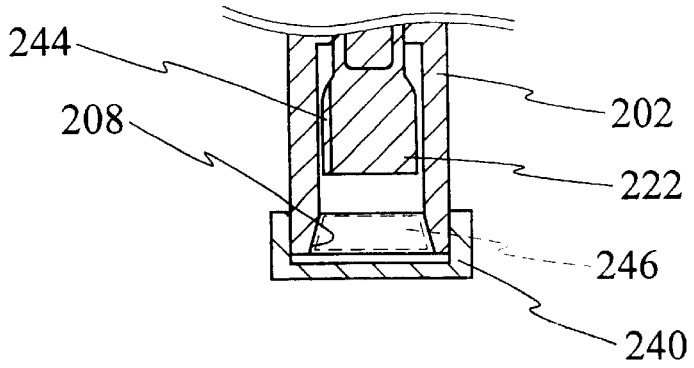
FIG. 9 is a sectional view of the lower end of the tee device shown in FIG. 9, modified with a cap.

If a tee device 200 having a piston of the construction shown in FIGS. 10, 11, is bottom plugged or capped as shown in FIG. 9, the axially directed channels or grooves 244 on the periphery of the piston may be separate from or simply an extension of the slit 262 for the purpose of allowing for movement of air from above to below the piston and vice versa as the ball support is adjusted to a desired height.

Figure 13:
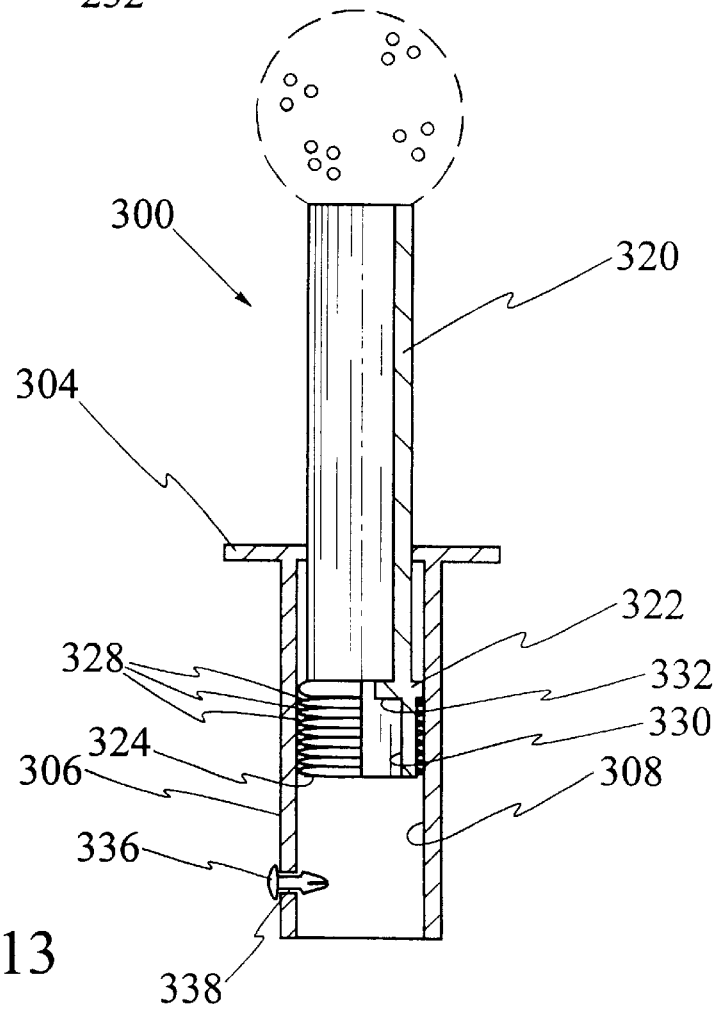
FIG. 13 is a partial sectional view of a further embodiment.

A still further embodiment of the tee 300 is shown in partial sectional view in FIG. 13 wherein the housing 302 has upper flange hollow cylindrical section 306 with internal bore 308. Tee slider 320 is similar construction to the tee slider or ball support 220 of FIG. 8 but has a shoulder flange 322 near the bottom 324 with a plurality of horizontal disposed ribs 328 between flange 322 and bottom 324.

The diameters of shoulder 322 and ribs 328 are such as to provide for relative movement between the slide 320 and housing 302 but with some change between the two. The bottom portion of slider 320 has a bore 330 and an inner flange 332 is contiguous with outer flange 322. Plastic rivet or retainer 336, when associated with hole 338 in the side of cylindrical section 306 of housing 302, prevents tee slider 320 from becoming disassembled from the housing 302.

Although flange 322 and ribs 328 provide sufficient drag to provide "feel" to the vertical adjustment, I have found that even smoother relative movement is achieved when ribs 328 and flange 322 have a minor amount of dry silicon lubricant or mould release agent associated with them.

In mounting my new adjustable tee assembly, the components shown in FIGS. 14–18 may be used, depending on the structure existing or being designed for a driving range.

Figure 14:
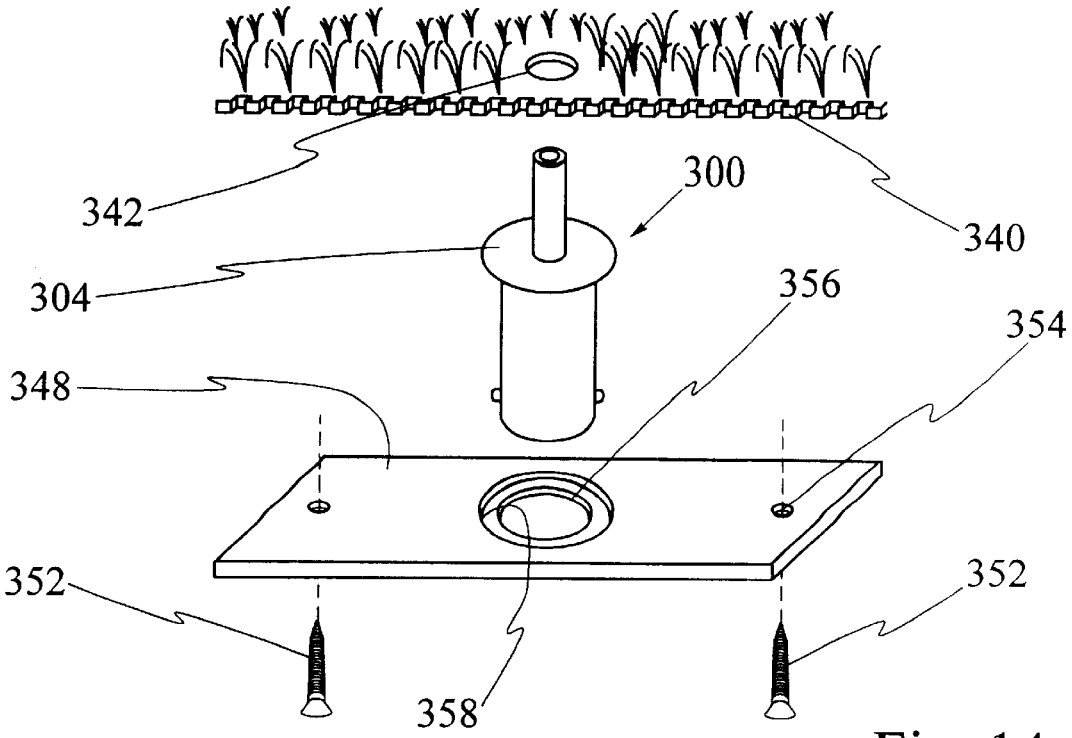
FIGS. 14, 15, 16, 17, 18 and 19 are perspective views of accessory components which can be used in the installation of the tee and to help to stabilize the mat adjacent the tee to which it is associated.

FIG. 14 illustrates the tee assembly 300 installation with fiber built mats 340 on a hard surface such as wood, asphalt or concrete (not shown). A hole 342 is drilled or punched in the mat 340 and an appropriate hole (not shown) is drilled in the hard surface. Plate 348 is fastened by fasteners 352 through plate holes 354 to the underside of the mat 340. Plate 348 has a hole 356 with a recess 358 to accept flange 304 of a tee assembly.

Figure 15:
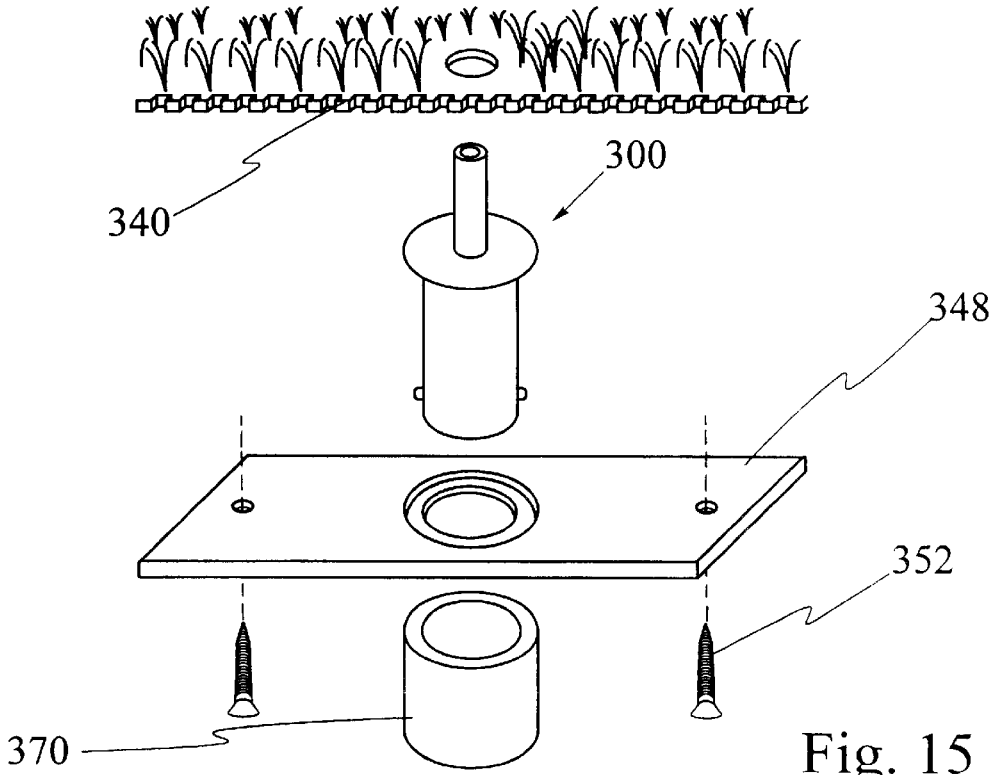

FIG. 15 illustrates a tee assembly 300 installation with fiber built mats on a loose surface (not shown) such as stone dust, gravel or dirt. The installation is similar to that for a hard surface (FIG. 14) but includes annular protector 370 (preferably of plastic) which is used to protect the base or housing of the tee assembly from the loose surface material.

Figure 16:
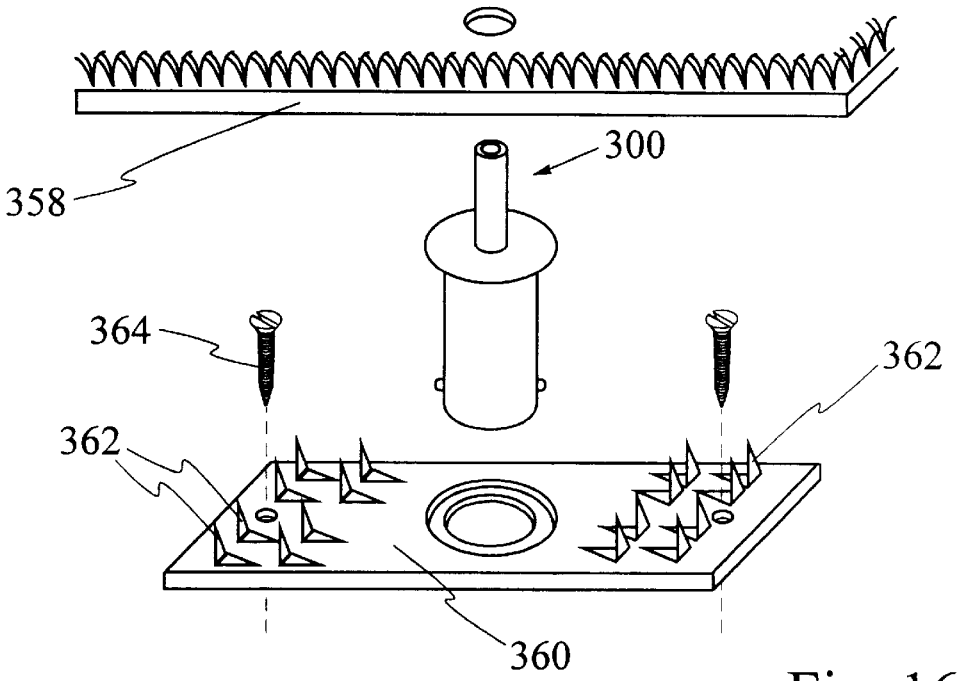

FIG. 16 illustrates a tee assembly 300 installation on a turf mat 358 on a hard surface (not shown). (A turf mat generally consists of short tufted or knit upper surface glued to a softer backing material.) Plate 360 has a plurality of tines 362 which dig into mat 358 to stabilize the mat adjacent the plate 360 and adjacent tee assembly 300. Fasteners 364 secure the plate to the hard surface. Appropriate holes are punched or drilled for the tee assembly in both the turf mat and hard surface (not shown).

Figure 17:
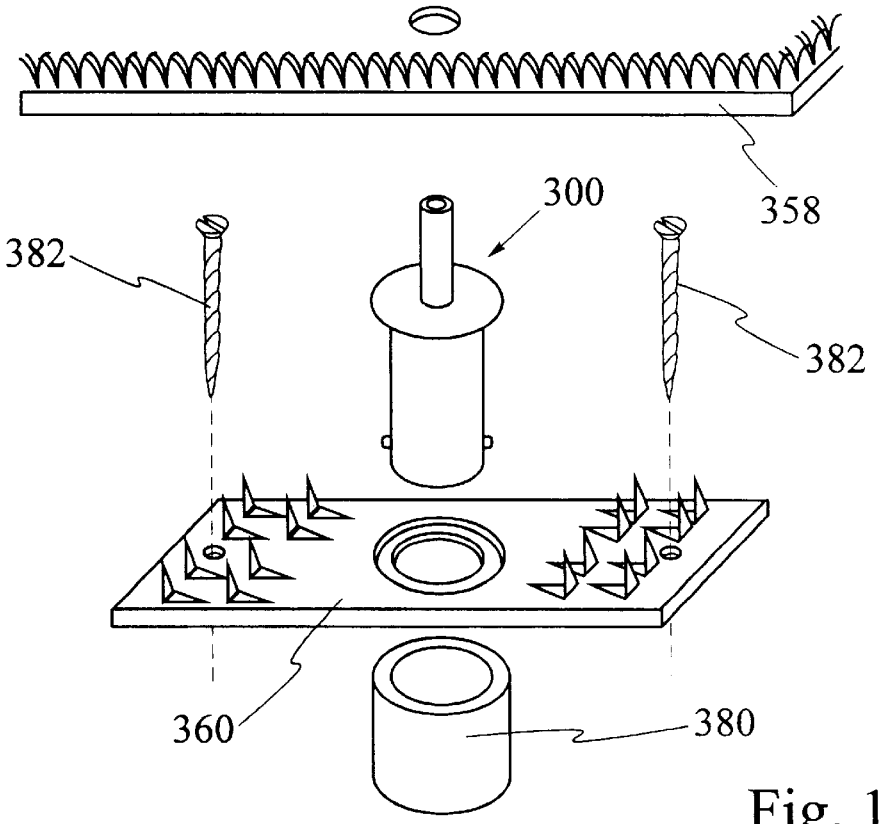

FIG. 17 illustrates a tee installation of a tee in association with turf mats on a loose surface (not shown). An annular protector 380 similar to that of the protector 370 in FIG. 15 is used. Further, long shanked, twist spikes 382 are used to anchor the plate into the loose surface (not shown).

Figure 18:
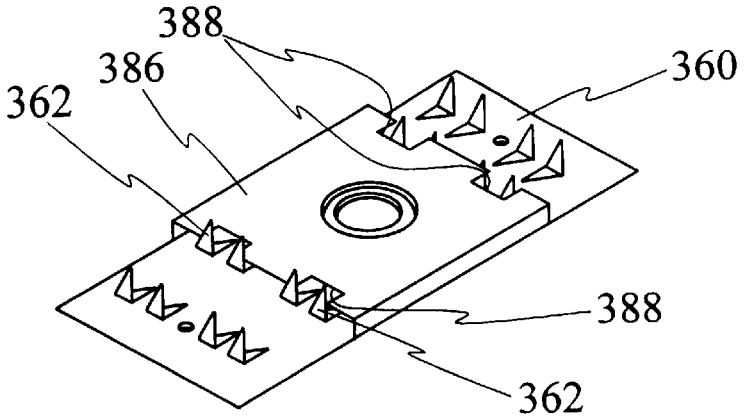

FIG. 18 shows a plate such as plate 360 with a protecting plate 386 for protecting the tee assembly base and flange from direct blows of a club not otherwise absorbed by the thin turf surfaces. Plate 386 has notches 388 which help lock the plate in place in association with certain of the tines 362.

Figure 19:
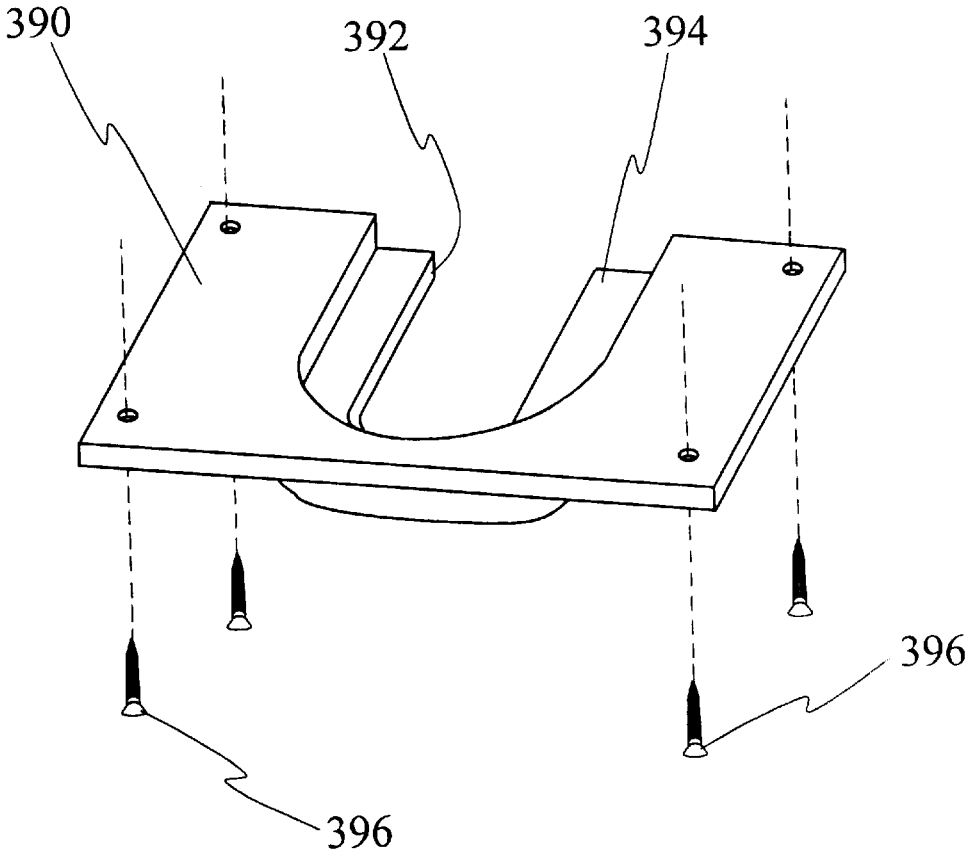

FIG. 19 illustrates a plate device 390 which is an alternative to plate 348 of FIG. 14 to stabilize the tee assembly when there is sufficient space between the fiber built mat and the surface or ground. Plate device 390 has opening 392 with shoulder recess 394 to accept the flange of a tee assembly. Fasteners 396 secure the device 390 to a fiber built mat (not shown).

It will be apparent to those skilled in the art that modifications to the preferred embodiment may be made without departing from the spirit of the invention.

The embodiments of the invention in which an exclusive property or privilege is claimed are defined as follows:

1. A golf ball tee device for a golf practice tee comprising:

housing means for securement with a base of the practice tee, said housing means having a bore with an upper end and lower end, said upper bore end having an opening;

piston means for movement within said housing bore;

golf ball support means connected to said piston means;

said housing means and piston means including cooperating means to provide controlled friction drag to relative movement therebetween;

said housing means and piston means including means to prevent longitudinal separation of said piston from said housing when in operation;

said ball support means and piston means being integral and said housing upper end opening comprising an opening having a diameter less than that of said housing bore, said housing means having a lower end open to said housing bore for assembly of said ball support and piston means to said housing means, and at least a portion of said piston means having a diameter and being of a material selected to cause a slidable fit with said housing bore.

2. The tee device of claim 1 wherein said piston means has a lower end and a bore extending inwardly from said lower end to a closed inner end, said bore defining a skirt to said piston means.

3. The tee device of claim 2 wherein said piston skirt has at least one axially directed slit extending from said lower end of said piston means to adjacent the inner closed end of said piston bore.

4. The tee device of claim 3 wherein the closed end of said piston bore has a groove peripherally around said inner closed end.

5. The tee device of claim 4 further including a generally circular spring within said groove whereby said slitted skirt is forced outwardly by said spring for friction contact with said housing bore.

6. The tee device of claim 5 further including means to effectively prevent separation of said housing means and piston means from the housing lower end once assembled.

7. The tee device of claim 6 further including means for closing said lower end once said piston means and housing means are assembled.

8. The tee device of claim 7 further including means to permit air from below said piston means to move past said piston means to above said piston means when said piston means is moved downwardly relative to said housing means and vice versa.

9. The tee device of claim 1 wherein said piston means comprises a cylindrical section having a peripheral wall and a lower end and having a plurality of ribs extending radially outwardly of said peripheral wall adjacent said lower end, said ribs being of a diameter to cause drag in cooperation with the bore of said housing means.

10. The tee device of claim 9 wherein said peripheral wall has a radially outwardly directed flange above said ribs of a diameter to cause drag in cooperation with the bore of said housing means.

11. The tee device of claim 10 wherein said piston means is hollow and has a lower cylindrical bore extending inwardly from the lower end, a flange extending radially inwardly of said lower end bore and radially contiguous with said outer flange.

* * * * *